United States Patent [19]

Schramer et al.

[11] Patent Number: 5,044,776

[45] Date of Patent: Sep. 3, 1991

[54] RESEALABLE CLOSURE SYSTEM

[75] Inventors: Kurt M. Schramer, Stow; K. Randy Snavely, Greensburg, both of Ohio

[73] Assignee: Morgan Adhesives Company, Stow, Ohio

[21] Appl. No.: 515,599

[22] Filed: Apr. 27, 1990

[51] Int. Cl.[5] ..... B65D 33/20

[52] U.S. Cl. ..... 383/89; 206/813; 428/41

[58] Field of Search ..... 383/89, 90, 88; 428/40, 428/41; 206/813

[56] References Cited

U.S. PATENT DOCUMENTS

| | | | |
|---|---|---|---|
| 2,681,732 | 6/1954 | Brady | 428/41 |
| 3,149,771 | 9/1964 | Pearl | 383/89 |
| 3,503,835 | 3/1970 | Hermann | 206/813 |
| 3,504,475 | 4/1970 | Dickard et al. | 383/89 |
| 3,806,024 | 4/1974 | Marchesani | 383/90 |
| 4,008,851 | 2/1977 | Hirsch | 206/813 |
| 4,557,505 | 12/1985 | Schaefer | 383/89 |
| 4,584,201 | 4/1986 | Boston | 383/89 |
| 4,871,265 | 10/1989 | Peck | 383/89 |
| 4,911,563 | 3/1990 | Ciani | 383/89 |
| 4,930,906 | 6/1990 | Hemphill | 383/89 |

*Primary Examiner*—Stephen P. Garbe

*Attorney, Agent, or Firm*—Oldham & Oldham Co.

[57] ABSTRACT

The invention disclosed provides a resealable closure system for a non-rigid product bag. The resealable closure system is generally an adhesive strip affixed to a non-rigid product bag which allows the bag to be reclosed a multiple number of times. The resealable closure system has a permanent adhesive on the first surface such that the system can be affixed to a non-rigid product bag and positioned between the top and the bottom of the bag. The second surface of the bag has a controlled peel adhesive disposed thereon. A release liner containing perforations cut essentially perpendicular to the system's length cover the controlled peel adhesive until use. These perforations permit defined segments of the release liner to be removed to expose new areas of adhesive thereby providing fresh securing sites for subsequent closure and sealing of the bag.

22 Claims, 2 Drawing Sheets

RESEALABLE CLOSURE SYSTEM

TECHNICAL FIELD

The present invention relates to a resealable closure system for a non-rigid product bag. More specifically, this invention relates to resealable closure system having at least one elongated adhesive strip, each strip having a first surface have a layer of permanent pressure sensitive adhesive disposed thereon, a second surface having a layer of controlled peel pressure sensitive adhesive disposed thereon, such that the first surface is affixed to a flexible product bag and the second surface has at least one release liner covering the outside surface of the controlled peel pressure sensitive adhesive.

BACKGROUND OF THE INVENTION

Many types of resealable closure methods and devices are known in the art and used to protect the contents of non rigid product bags. A large number of these devices, for instance, twist ties, plastic clips and zippered locking means are primarily used with thin plastic bags (eg: polyethylene) used for packaging bread products and the like. Twist ties and plastic clips have several disadvantages due principally to the fact that the resealable seals are not part of the container. The plastic clips or twist ties may often be misplaced between uses and also require some degree of fine motor control, therefore making their use difficult for the young, the elderly and the physical handicapped. Additionally, after repeated use, plastic clips often break and twist ties expose their sharp metal wire support making their use potentially hazardous. These type of closures can also tear the flexible containers. Zippered locking means do provide an effective air tight seal. However this construction adds substantially to the cost of each container and these systems also require some fine motor control which may prove difficult for some user populations.

Until now, few satisfactory closure systems were available for the heavier weight foil, paper bags or multiwalled laminate used to package such items as potato chips and other snack items, lawn care products, bulk packaging, dog food and the like. Twist ties and plastic clips of sufficient size to seal these heavier bags, suffer the same defects found in their prior use. Many consumers have attempted to utilize paper clips, staples and rubber bands. However, these items are also likely to break, be misplaced and suffer a variety of other disadvantages which made their use undesirable. Additionally, other uses will transfer the remaining contents to reclosable containers such as plastic tubs, zippered bags and the like.

Devices which pinch or clip the bag closed upon itself have been used. However, these items are not supplied with the product and, in fact, oftentimes must be purchased separately.

Therefore, a common method of closing such non rigid product bags involves expelling the air from the bags, pressing two sides of the bag together and rolling the bag down from the top. The consumer normally relies on a number of folds or creases made in that rolled portion of the bag to hold the shape of this rolled portion and to keep out undesired moisture and air. However, over time or as a bag is transported the rolled portion loosens and may permit the contents to spill out or allow air and moisture to enter the bag through the opening, thereby causing the product to spoil, become stale or take on other potentially undesirable properties.

SUMMARY OF THE INVENTION

The present invention discloses a resealable closure system for non rigid product bags. A preferred embodiment of the invention discloses a rectangular elongated strip of carrier material or film with a permanent pressure sensitive adhesive disposed on a first surface and a controlled peel pressure sensitive adhesive on the second surface. The first surface is affixed to a non rigid product bag such that the strip is positioned between the top and the bottom of the bag and running a substantial length along the approximate longitudinal midline. A release liner is disposed on the carrier's second surface to protect the controlled peel pressure sensitive adhesive until use by the consumer. The release liner has perforated cuts at an angle preferably perpendicular to the length of resealable closure system. These perforations permit defined segments of the release liner to be removed individually to expose new areas of the pressure sensitive adhesive thereby providing fresh securing sites for subsequent closure and sealing of the bag.

Therefore, it is an object of the present invention to provide an inexpensive and integrated means and method for resealing a non rigid product bag.

It is also a object to provide a means for closing a non rigid product bag which is reliable and can be easily used a multiple number of times without failing to seal. It is also an object of the present invention to provide a means for resealing a non rigid product bag which allows printing on the carrier of the adhesive strip or on the associated release liner.

It is also an object of the present invention to provide a means for resealing a non rigid product bag which can be used or adapted for use on a large number of different types of non rigid product bags.

It is also an object of the present invention to provide a means for resealing a non rigid product bag which is made from a heavy gauge plastic, foil, paper or laminate combinations commonly used to contain potato chips and other snack items, dog food, lawn care products and a variety of other food and non food items.

It is a further object of the present invention to provide a means for reclosing a non rigid product bag which is normally rolled, folded or creased to seal the contents from air and moisture and to prevent spilling of the bag's contents.

It is still a further object of the present invention to provide a means for resealing a non rigid product bag which provides multiple closing sites, allowing the user to continuously reduce the void space inside the product bag as the product volume decreases.

It is still a further object of this invention to provide a means for resealing a non rigid product bag which is simple to use and requires a minimal amount of motor control or consumer education.

It is still a further object of this present invention to provide a means for reclosing a non rigid product bag wherein the closure system can be attached to the bag as a part of an inline manufacturing of the product prior to its functional use with food and non food products deposited therein.

These and other objects may be accomplished with the present invention which comprises a resealable closure system for a non rigid product bag comprising at least one elongated strip of carrier material having a first and a second surface, an adhesive layer having a first adhesion strength disposed on at least a portion of said first surface of each said carrier strip to bond with said non rigid product bag, an adhesive layer having a second adhesion strength disposed on at least a portion of said second surface of each said carrier strip said second adhesion strength being less than said first adhesion strength, at least one release liner positioned on said layer of adhesive on said second surface of each carrier strip with a controlled, non-permanent bond and acting to protect said adhesive layer until use of at least a portion of said resealable closure system, said release liner comprising a means for defining a plurality of release liner segments such that such release liner segments can be removed individually from said second surface of said face material.

BRIEF DESCRIPTION OF THE DRAWINGS

Reference should be made to the accompanying drawings wherein.

DETAILED DESCRIPTION OF THE PREFERRED EMBODIMENT

This invention will be described in detail with reference to the preferred embodiment thereof. Like elements are identified by referenced numerals throughout the drawings and the specification.

Figure 1:
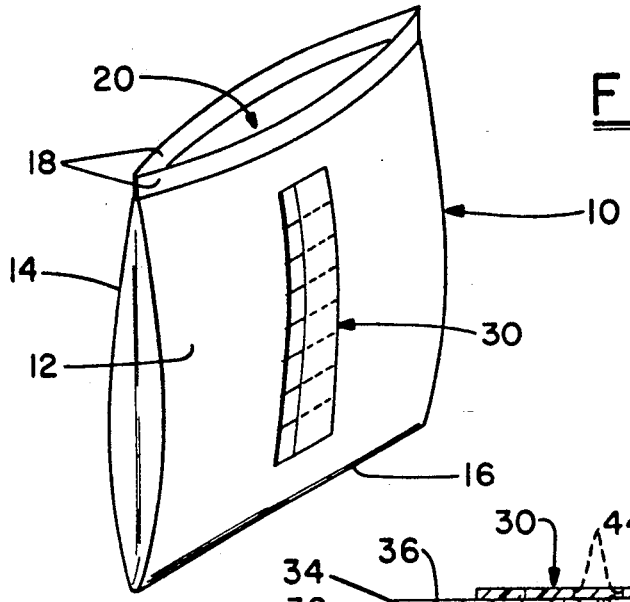
FIG. 1 is a perspective view of a non rigid product bag incorporated the resealable closure system of the present invention.

Now, with reference to the drawings, FIG. 1 illustrates a preferred embodiment of the present invention as a resealable closure system, generally 30, installed on a non rigid product bag 10. Non rigid product bag 10 is generally contemplated as a multiple serving food product bag which would likely be reclosed multiple times after the bags initial opening. Such a flexible product bag 10 may contain items such as potato chips, snack items, dog food or a variety of other food or non-food products. Additionally, this reasonable closure system of the present invention would be equally adaptable to non rigid bags used in the bulk packaging of many products such as baking flour, charcoal, lawn products, etc. Product bag 10 is disclosed as a foil, paper or multi-walled laminate bag, but this resealable closure system 30 is contemplated as being used on a variety of other bag material such as plastic.

FIG. 1 further illustrates a non rigid product bag 10 as being of uniform construction and having a front section 14, a rear section 12 and a bottom 16. Front section 14 and rear section 12 are relatively similar and do not differ in function. Differences in the two sections are principally related to the aesthetic arrangement of the printing on the outside of the bag itself and possibly the presence of a seam on the rear section 12. Flexible product bag 10 discloses a top seal 18 which is a single use seal applied during the original filling of flexible product bag 10. This seal defines an opening 20.

Resealable closure system 30 is disclosed in FIG. 1 as an elongated rectangular strip having a length substantially greater than the corresponding width. While a rectangular length is disclosed and preferred, other shapes such as ovals, etc and a wide variety of strip 30 sizes are contemplated. The closure system 30 in the preferred embodiment as shown as positioned on the outside of the product bag 10; generally in the middle of either the front section 14 or the rear section 12 such that the closure system 30's longitudinal axis is perpendicular to the top seal 18 and the closure system 30 runs a substantial length between top seal 18 and bottom 16.

Figure 2:
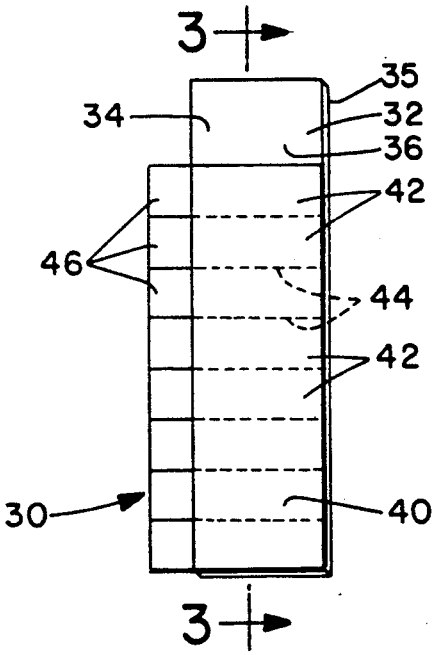
FIG. 2 is a top elevational view of one preferred embodiment of the resealable closure systems of the present invention.

Referring now to FIG. 2, the resealable closure system 30 comprises a strip of carrier material 32, a layer of permanent adhesive 38 disposed on side 35 of the carrier material 32 and a layer of controlled peel pressure sensitive adhesive 36 disposed on the side 34 of carrier material 32. A release liner 40 is removably attached to the adhesive layer 36 in a manner well understood by one skilled in the art. Release liner 40 has perforated lines 44 cut therein such that release liner segments 42 of release liner 40 may be individually removed.

The carrier material 32, provides a surface upon which the adhesives may be placed. Carrier strip 32 may be a paper, plastic, vinyl or any other suitable material and is preferably flexible and tear resistant. First surface 35 of carrier material 32, or any portion thereof is coated with a high energy adhesive 38 to form an essentially permanent bond with the non rigid product bag 10. In the preferred embodiment this adhesive layer 38 is generally a rubber base adhesive, although other types of adhesives could be substituted by those knowledgeable in the art. Alternatively, the resealable closure system 30 could be attached to the bag using a heat lamination or ultrasonic welding process, thereby creating a bond between the face material 32 and the product bag 10. In any event, the bonding of surface 35 to the product bag 10 will be essentially permanent and have a greater strength than any bond formed between the second surface 34 of carrier material 32 and any mounting surface.

The second surface 34 of carrier material 32 is coated with a controlled peel non-permanent adhesive 36. This adhesive 36 is disclosed as an acrylic adhesive possessing qualities of quick and non-permanent adhesion, but other types of adhesives are contemplated. This adhesive 36 is designed to provide a non-permanent but secure closure when contacted by any mounting surface. The adhesive layer 36 may be of the type which maintains a secure closure even after multiple uses. However, adhesive layer 36 is also contemplated as comprising an adhesive which maintains a secure closure for up to about five (5) uses and is therefore, more economical than an adhesive layer 36 capable of multiple closures. Non-permanent adhesive layer 36 should possess excellent quick-tack characteristics, while still allowing easy removal of the release liner 40 or segment 42 thereof. Adhesive layer 36 should maintain a relatively constant adhesive strength so that after the quick-tack, there is no substantial growth in adhesion strength. It is also desirable that adhesive layer 36 will not permanently adhere to itself.

Figure 4:
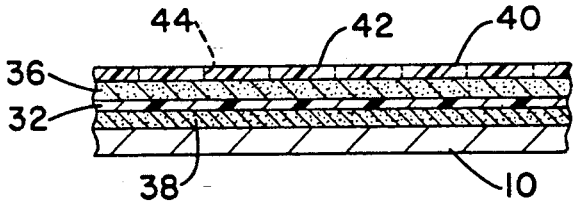
FIG. 4 is a partial longitudinal cross sectional view of one preferred embodiment of the resealable closure system.

As illustrated in FIGS. 2 and 4, adhesive layer 36 is covered by a release liner 40 to protect adhesive layer 36 until use by the consumer. The release liner 40 is dimensioned as having substantially the same or greater length and width as adhesive layer 36. Release liner 40 is made of materials well known in the art such as paper, polyethylene, polypropylene and PET or any laminate combination of the above, which are easily removed from adhesive layer 36 and can be coated with silicones or other materials to assist in the initial tack but easy removal of release liner 40 from adhesive layer 36.

The preferred embodiment shown in FIG. 2 illustrates release liner 40 as disposed on adhesive layer 36. Pull tab 46 is disclosed a portion of release liner 40 which extends beyond the adhesive layer in at least one direction to aid in the removal of the release liner from adhesive layer 36. Pull tab 46 is well known in the art and alternatively any other means well known in the art which aids in the removal of a release liner from adhesive layer 36 may be utilized.

Figure 3:
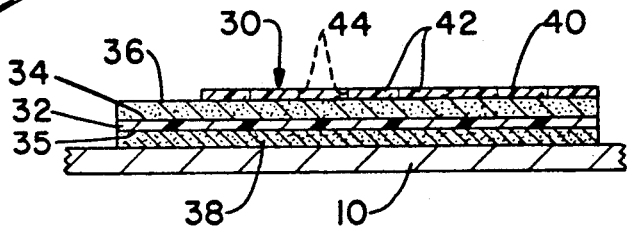
FIG. 3 is a partial longitudinal cross sectional view of one embodiment of the resealable closure system taken across line 3—3 of FIG. 2 wherein one release liner segment has been removed for purposes of illustration.

FIG. 2 further discloses the release liner 40 of the preferred embodiment as having a plurality of perforated cuts 44 made across at least a substantial width of the release liner 40 to divide release liner 40 into a plurality of release liner segments 42. Such perforated cuts 44 are provide so that each release liner segment 42 may be individually removed from the resealable closure system 30 to expose a new area of adhesive layer 36 as illustrated in FIG. 3.

Resealable closure system 30 would likely be applied to the non rigid product bag 10 during the manufacturing of such bags. Strips of carrier material 32 which had been previously coated with the designated adhesives would be fed from a continuous tape, cut to size and placed on the non rigid product bag 10 as part of the product bags in line manufacturing process. Alternatively the strips of carrier material 32 can be converted and die cut off line and supplied as discontinuous "labels" on a continuous release liner.

The strength of the adhesives are not only important with respect to the reclosable nature of the system 30 but the resealable closure system 30 must be able to withstand the stress which occurs during the automated packaging process of the non rigid product bag 10. The adhesive 38 on the first surface 35 of the carrier material 32 must be sufficient to hold the carrier material in place during this process. The adhesive layer 36 on the second surface 34 is designed such that it has a tight bond with the release liner which inhibits removal during the manufacture but allows the user to easily remove the liner 40. Additionally, it is important controlled peel adhesive of layer 36 be sufficient to hold each release liner segment 42 in place as the adjacent segment is removed. In furtherance of this objective, the perforated cuts 44 must allow for easy tear along these lines.

The flexible product bag 10 would likely be filled with product and sealed at top seal 18 at the product manufacturing facility. Resealable closure system 30 would be utilized to reseal the flexible product bag 10 after the initial opening of the seal 18 by the consumer. To seal such product bags 10, consumers commonly expel the air from the bag, press the front and back sections, 14 and 12, together and tightly roll the empty portion of the bag down the bag's longitudinal axis to reduce the void space inside bag 10, relying on folds or creases in the product's bag to maintain the rolled portion of the bag 22 in a closed position. However, the rolled portion 22 of the bag 10 commonly unrolls or loosens in time permitting the contents to spill out or moisture and air to enter the bag, thereby causing the product to spoil or become stale.

The preferred embodiment of the present invention provides a resealable closure system 30 which prevents or greatly reduces the rolled portion 22 of the non rigid product bag 10 from unrolling and thereby greatly reduces the amount of air and moisture which enters the bag. After the air is expelled from the bag, the front and back sections, 14 and 12 are pressed together and rolled down the longitudinal axis of the product bag 10 from the top until the rolled portion nears the portion of the bag 10 containing the product. This reduces the void space inside of the product bag 10. The consumer removes a segment 42 of the release liner 40 by pulling the segment 42 by using pull tab 46, along the perforated lines 44 in release liner 40. Removal of one or more segments 42 of release liner 40 exposes an area of adhesive layer 36 to which rolled portion 22 may be attached, by pressing it moderately against the adhesive layer 36. This resealable closure system 30 greatly improves the ability to maintain a products freshness and further allows the product bag 10 to be transported while maintaining a secure closure between product dispensing to prevent product spilling.

It is contemplated that this resealable closure systems 30 will be used primarily on flexible product bags 10 containing multiple servings. Additionally, it is recognized that the effectiveness of certain adhesives is reduced over time, after repeated exposure to consumer contact, airborne dust, particles and contaminants and after repeated use. With multiple use bags 10, small particles of product and other materials may adhere to the exposed area of adhesive, thereby reducing the effectiveness of that adhesive layer. Therefore, a plurality of release liner segments 42 are provided along the longitudinal axis of the resealable closure system 30 to provide additional areas of adhesive layer 36 when a previous layer has lost significant adhesive strength. Furthermore a new area of adhesive layer 36 may be desired when more product has been removed from the bag and it is now necessary to reduce the amount of void space inside the bag 10 and to include a greater portion of bag 10 in the rolled portion of the bag 22, requiring a new securing site located closer to the bottom 16 of bag 10.

Figure 5:
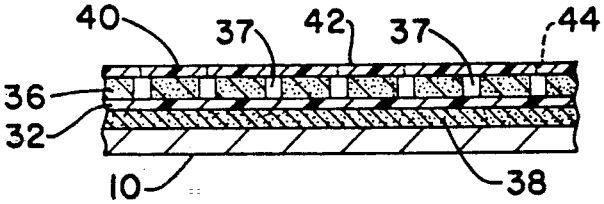
FIG. 5 is a partial longitudinal cross sectional view of an alternative embodiment of the resealable closure system of the present invention.

Another embodiment is illustrated in FIG. 5, whereby adhesive layer 36 is separated by regions 37 which do not contain adhesives. In such an embodiment, each perforated cut 44, is positioned above a non-adhesive coated region 37 for ease of removal of each release liner segment 42. Additionally, it is contemplated that release liner 40 could also be formed from a plurality of individual release liner segments 42 covering each area of the adhesive layer 36 in this embodiment and separated by the non-adhesive coated regions 37.

Figure 6:
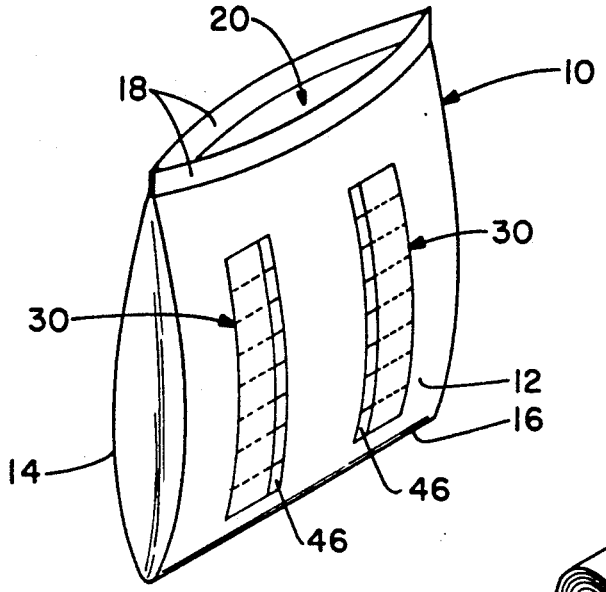
FIG. 6 is a perspective view of an alternative embodiment of the resealable closure system of the present invention.
Figure 7:
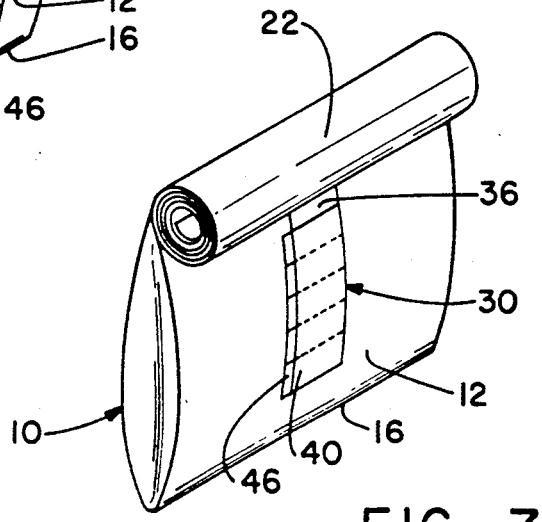
FIG. 7 is a perspective view of a non rigid product bag as sealed using one embodiment of the resealable closure system of the present invention.

FIG. 6 illustrates another embodiment wherein more than one resealable closure system 30 is used on a single non rigid product bag 10. Any number of such systems 30 could be used and are desirable when additional closure strength is needed or non rigid product bag 10 has a width which requires more than one resealable closure system 30 to maintain an airtight seal. When two or more systems 30 are utilized it is preferred that at least one system 30 is located near each end of rolled portion 22 and approximately equidistant from the bag's longitudinal center line.

Figure 8:
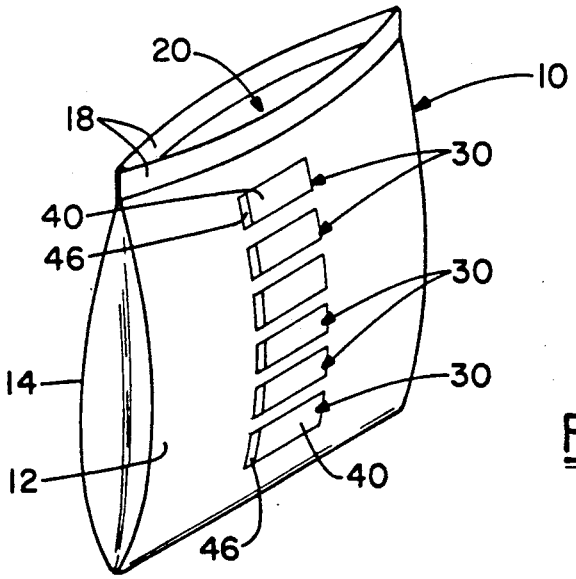
FIG. 8 is a perspective view of an alternative embodiment of the resealable closure system of the present invention.

FIG. 8 discloses still another embodiment wherein the resealable closure system 30 comprises a plurality of a smaller separated resealable closure systems 30 in generally linear alignment along the approximate mid line of product bag 10.

Typically, for aesthetic reasons the resealable closure system 30 will be affixed to the rear section 12 of flexible product bag 10. However such systems 30 function equally as well when disposed on the front section 14 of bag 10. Face material 32 and release liner 40 may be made of a transparent, translucent or opaque material, all of which are well known in the art. It is contemplated and well known in the art that face material 32 and/or release liner 40 may be made of such material capable of accepting printing thereon.

The respective terms "permanent pressure sensitive adhesive" and "controlled peel pressure sensitive adhesive" are used in their well known, art recognized meanings. A permanent adhesive is one which forms a strong bond with the substrate to which it has been applied, so that neither the adhesive nor the adherents surface (other than a release coated backing such as a silicone liner) can be used without damage. A controlled peel pressure sensitive adhesive, on the other hand, is one which can be peeled off together with the backing to which it is applied from a substrate surface without damage to either the adhesive or the backing. In other words, in the instant situation, the controlled peel adhesive layer 36 will stay adhered to rolled portion 32 of the non rigid product bag 10 but will easily remove from the rolled portion 22.

The thickness, coating weight and methods of application of the permanent and pressure sensitive adhesive layers are similar to those of known teachings or are generally from about 0.5 to 4 mils, desirable from about 1 to about 2 mils preferable about 1.5 mils thick.

Furthermore, the adhesives 38 and 36 on face material 32 are designed to provide consistent adhesion in a broad range of temperatures. It is contemplated that certain food items which are packaged in flexible containers of this type may be stored in the refrigerator or freezer. It is, therefore, desirable to provide a pressure sensitive adhesive which will function over these temperature ranges. For example, an acrylic based adhesive as previously described with reference to adhesive layer 36 should have characteristics to allow proper functioning at room and refrigerator temperatures. For applications where freezer temperatures will be encountered, a "softer" pressure sensitive adhesive may be necessary. Such an adhesive allows retention of the flexibility, quick-tack and quick-peel properties even at freezer temperatures. In such an application, it must also be considered that condensation will form on the container when removed from the freezer. A suitable adhesive having the above characteristics to function on cold and possibly moist surfaces may be a rubber or polyisobutylene based adhesive, or may be a suitably modified acrylic based adhesive. The glass transition temperature of the adhesive can be lowered to accommodate this function. The particular formulation of the adhesive layers of the invention are not critical as long as the desirable characteristics are obtained.

While in accordance with the patent statutes the best mode and preferred embodiment of the invention has been described, it is to be understood that the invention is not limited thereto, but rather is to be measured by the scope and spirit of the appended claims.

What is claimed is:

1. A resealable closure system for a non rigid product bag comprising:

an elongated strip of carrier material having a first and a second surface, an adhesive layer having a first adhesion strength disposed on at least a portion of said first surface of said carrier material to bond with said non rigid product bag, an adhesive layer having a second adhesion strength disposed on at least a portion of said second surface of said carrier material, said second adhesion strength being less than said first adhesion strength, at least one release liner positioned on said layer of adhesive on said second surface of said carrier strip material with a controlled, non-permanent bond and acting to protect said adhesive layer until use of at least a portion of said resealable closure system, said release liner comprising means for defining a plurality of release liner segments such that such release liner segments can be removed individually from said second surface of said face material.

2. The resealable closure system as recited in claim 1 wherein said means for defining a plurality of release liner segments comprises a plurality of perforated cuts across a substantial width of the release liner of said resealable closure system.

3. The resealable closure system as recited in claim 2 wherein said perforated cuts are essentially perpendicular to a longitudinal axis of said strip of carrier material.

4. A resealable closure system as recited in claim 1 wherein said adhesive layer having a second adhesion strength is separated into a plurality of adhesive regions.

5. A resealable closure system as recited in claim 4 wherein each adhesive region is covered by its own release liner.

6. A resealable closure system as recited in claim 1 wherein said adhesive layer having a first adhesion strength comprises a permanent pressure sensitive adhesive.

7. A resealable closure system as recited in claim 6 wherein said permanent pressure sensitive adhesive is a rubber base adhesive which forms an essentially permanent bond with said flexible product bag.

8. A resealable closure system as recited in claim 1 wherein said adhesive layer having a first adhesion strength is an acrylic base adhesive.

9. A resealable closure system as recited in claim 1 wherein said adhesive layer having a first adhesive strength comprises a heat seal which bonds said resealable closure system to said container with said first adhesion strength.

10. A resealable closure system as recited in claim 1 wherein said adhesive layer having a second adhesion strength comprises a permanent pressure sensitive adhesive.

11. A resealable closure system as recited in claim 10 wherein said permanent pressure sensitive adhesive is a rubber base adhesive.

12. A resealable closure system as recited in claim 1 wherein said adhesive layer having a second adhesion strength comprises a controlled peel pressure sensitive adhesive.

13. A resealable closure system as recited in claim 12 wherein said removable said pressure sensitive adhesive is an acrylic base adhesive having aggressive adhesion characteristics after which growth of the adhesion strength is inhibited to form a non-permanent bond.

14. A resealable closure system as recited in claim 12 wherein said pressure sensitive adhesive provides consistent adhesion characteristics over a range of temperatures, so as to be usable at freezer or refrigerator temperatures as well as room temperature.

15. A resealable closure system as recited in claim 1 wherein said pressure sensitive adhesive on said first or second surface thereof enables said strip to be used a multiple number of times.

16. A resealable non rigid product bag having a resealable closure system comprising:

a non rigid product bag, an elongated strip of carrier material having a first and second surface, an adhesive layer having a first adhesion strength disposed on at least a portion of said first surface of said carrier material to bond with said flexible product bag, an adhesive layer having a second adhesion strength disposed on at least a portion of said second surface of each said carrier material, said second adhesion strength being less than said first adhesion strength, at least one release liner positioned on said layer of adhesive on said second surface of said carrier strip with a controlled, non-permanent bond and acting to protect said adhesive layer until use of at least a portion of said resealable closure system is desired, said release liner comprising means for defining a plurality of release liner segments such that said release liner segments can be removed individually.

17. The resealable product bag as recited in claim 16 wherein said means for defining a plurality of release liner segments comprises a plurality of perforated cuts in the release liner of said resealable closure system.

18. The resealable product bag as recited in claim 17 wherein said perforated cuts are essentially perpendicular to a longitudinal axis of said resealable closure system.

19. A resealable flexible product bag according to claim 18 wherein a reclosure system is positioned on a substantial length of a midline running between a top edge and a bottom edge of said non rigid bag and bonded thereon with said first adhesion strength.

20. A resealable product bag according to claim 19 wherein a plurality of resealable closure systems are positioned on a plurality of lines running between a top edge and a bottom edge of said non rigid product bag and bonded thereon with said first adhesions strengths.

21. A method of repeatedly closing a flexible product bag having at least one open end and comprising the steps of:

affixing at least one resealable closure system to said non rigid product bag, said resealable closure system comprising an elongated carrier strip having a first and a second surface, said first surface having an adhesive layer having a first adhesion strength disposed on at least a portion thereon such that said first surface is permanently affixed to said non rigid product bag, said second surface having an adhesive layer having a second adhesion strength disposed on at least a portion thereof for application to a mounting surface, said second adhesion strength being less than said first adhesion strength, a release liner dimensioned at least equal to the carrier strip and contacting said second surface of said strip with a controlled adhesive bond, said release liner comprising a means for defining a plurality of release liner segments;

expelling at least a substantial portion of air from said bag through said open end;

substantially closing said open end of said non rigid product bag;

folding said open end of said product bag upon itself repeatedly to reduce a void space on the inside of said bag;

removing at least one release liner segment from said second surface of said resealable closure strip, thereby activating the non-permanent adhesive;

attaching said open end to said activated non-permanent adhesive on said second surface of each resealable closure system to thereby maintain the substantially closed position of said open end of said product bag.

22. The method according to claim 21 wherein said step of removing a release liner segment from said second surface of said adhesive strip and said step of attaching said open end of said product bag to said activated non-permanent adhesive may be repeated for each release liner segment.

* * * * *